US006876358B2

(12) United States Patent
Arai

(10) Patent No.: US 6,876,358 B2
(45) Date of Patent: Apr. 5, 2005

(54) MULTI-SYNC DISPLAY APPARATUS

(75) Inventor: Yutaka Arai, Atsugi (JP)

(73) Assignee: NEC-Mitsubishi Electric Visual Systems Corporation, Tokyo (JP)

( * ) Notice: Subject to any disclaimer, the term of this patent is extended or adjusted under 35 U.S.C. 154(b) by 298 days.

(21) Appl. No.: 10/322,481

(22) Filed: Dec. 19, 2002

(65) Prior Publication Data

US 2003/0117390 A1 Jun. 26, 2003

(30) Foreign Application Priority Data

Dec. 25, 2001 (JP) ..... P2001-392348

(51) Int. Cl.[7] ..... G09G 5/00
(52) U.S. Cl. ..... 345/211; 345/213
(58) Field of Search ..... 345/211, 213

(56) References Cited

U.S. PATENT DOCUMENTS

| | | | | |
|---|---|---|---|---|
| 4,860,090 A | | 8/1989 | Murata et al. | |
| 5,337,023 A | * | 8/1994 | Hobrecht | 331/20 |
| 5,686,968 A | * | 11/1997 | Ujiie et al. | 348/521 |
| 5,929,711 A | * | 7/1999 | Ito | 331/1 A |
| 6,133,900 A | * | 10/2000 | Esaki | 345/660 |
| 6,333,751 B1 | * | 12/2001 | Torii et al. | 345/698 |
| RE38,537 E | * | 6/2004 | Kim | 345/13 |

FOREIGN PATENT DOCUMENTS

| | | |
|---|---|---|
| EP | 0 463 418 A2 | 1/1992 |
| JP | 6-112820 A | 4/1994 |
| JP | 10-51272 A | 2/1998 |
| JP | 10-271102 A | 10/1998 |

* cited by examiner

*Primary Examiner*—Michael Razavi
*Assistant Examiner*—Rodney Amadiz
(74) *Attorney, Agent, or Firm*—Sughrue Mion, PLLC

(57) ABSTRACT

There is provided a multi-sync type of display apparatus that enables changes in input signals to be accurately determined while increasing the accuracy when identifying input synchronization signals. When input synchronization signals Wa are within a predetermined phase difference, a pseudo synchronization signal generation apparatus formed by a frequency detection section 7 and a pseudo synchronization signal generation section 8 generates pseudo synchronization signals Wd that are synchronized with the input synchronization signals Wa. If the input synchronization signals Wa exceed a predetermined phase difference, pseudo synchronization signals Wd that have the frequency of the synchronization signal directly before the input synchronization signals Wa are generated. A phase comparison section 9 compares the pseudo synchronization signals Wd and the input synchronization signals Wa, and outputs comparison result signals when the phase difference exceeds a predetermined phase difference. If the comparison result signals continue to be output for N number of times, a signal change determination section 10 outputs a signal change determination signal. A display control section 5 controls R, G, B signals and displays image signals on a display element 6. Accordingly, it is possible to set the predetermined phase difference to a small value and increase the accuracy when identifying similar input synchronization signals, while also reducing erroneous operation by increasing the number N.

6 Claims, 4 Drawing Sheets

MULTI-SYNC DISPLAY APPARATUS

BACKGROUND OF THE INVENTION

1. Field of the Invention

The present invention relates to a multi-sync display apparatus that selectively displays a plurality of types of image signals that have synchronization signals of respectively different frequencies. This application claims priority on Japanese Patent Application No. 2001-392348 the contents of which are incorporated herein by reference.

2. Description of the Related Art

Conventionally, in a multi-sync display apparatus that switches and selects a plurality of types of image signals having different synchronization signals output from a plurality of personal computers (PC), and displays one of these image signals, input synchronization signals are identified by detecting the frequency and polarity of synchronization signals input in synchronization with the image signals, and the display of the display apparatus is controlled in accordance with the identified synchronization signals.

In the method in which the display is controlled by detecting the frequency and polarity of the input synchronization signals, as described above, when the plurality of types of image signals are switched, if the synchronization signals before the switching are similar to the synchronization signals after the switching, then the problem has occurred that identifying the synchronization signals has not been possible, and therefore normal display control cannot be performed. In particular, in the case of a multi-sync type of display apparatus that uses a digital display apparatus such as a liquid crystal display, because it becomes impossible to perform a normal display if there is even a slight discrepancy in the synchronization signals, an extra burden has been placed on the user, for example, by requiring the user to perform manual adjustment and the like. If the frequency detection sensitivity when detecting input synchronization signals is raised as a means of dealing with this problem, the further problem arises that single lapses in synchronization and noise and the like are detected in error, resulting in a lowering in the detection accuracy.

The present invention was conceived in order to solve the above problems, and it is an object thereof to provide a multi-sync display apparatus that enables erroneous detections caused by lapses in synchronization and noise and the like to be prevented while increasing the accuracy with which similar input synchronization signals are identified.

SUMMARY OF THE INVENTION

In order to achieve the above object the present invention is a multi-sync display apparatus comprising: a pseudo synchronization signal generation means that, when input synchronization signals are within a predetermined phase difference, generates pseudo synchronization signals that are synchronized with the input synchronization signals, and that, when the input synchronization signals exceed a predetermined phase difference, generates pseudo synchronization signals having a frequency of the synchronization signal directly before the input synchronization signal that exceeds the predetermined phase difference; phase comparison means that performs phase comparison on the pseudo synchronization signals and the input synchronization signals, and outputs comparison result signals when the phase difference between the pseudo synchronization signals and the input synchronization signals exceeds a predetermined phase difference; and signal change determination means that, when the comparison result signals are continuously output for a plurality of times, outputs a signal change determination signal indicating that the input synchronization signals have changed.

According to the above structure, when input synchronization signals are within a predetermined phase difference, the pseudo synchronization signal generation means generates pseudo synchronization signals that are synchronized with the input synchronization signals. If the input synchronization signals exceed a predetermined phase difference, the pseudo synchronization signal generation means generates pseudo synchronization signals that have the frequency of the synchronization signal directly before the input synchronization signal that exceeds the predetermined phase difference. The phase comparison means performs phase comparison on the pseudo synchronization signals and the input synchronization signals, and outputs comparison result signals when the phase difference between the two exceeds a predetermined phase difference. When the comparison result signals continues for a predetermined number of times N(N=2, 3, . . . ) it is determined that there has been a signal change. Therefore, if the input synchronization signals are similar within the above predetermined phase difference, then this can be identified. Accordingly, by setting the predetermined phase difference to a small value, it is possible to increase the identification sensitivity. In addition, by increasing the predetermined number of times N, it is possible to reduce erroneous operation caused by synchronization lapses and noise and the like, while reducing the predetermined phase difference and increasing the identification accuracy.

Accordingly, because a structure is employed in which, when input synchronization signals are within a predetermined phase difference, the pseudo synchronization signal generation means generates pseudo synchronization signals that are synchronized with the input synchronization signals, and if the input synchronization signals exceed a predetermined phase difference, the pseudo synchronization signal generation means generates pseudo synchronization signals that have the frequency of the synchronization signal directly before the input synchronization signal that exceeds the predetermined phase difference. In addition, because a structure is employed in which the phase comparison means performs phase comparison on the pseudo synchronization signals and the input synchronization signals, and outputs comparison result signals when the phase difference exceeds a predetermined large phase difference, and it is determined that there has been a signal change when the comparison result signals continue for a predetermined number of times, by setting the predetermined phase difference to a small value, it is possible to identify similar input synchronization signals with a high degree of accuracy, and by increasing the predetermined number of times N, it is possible to reduce erroneous operation caused by synchronization lapses and noise and the like.

DESCRIPTION OF THE PREFERRED EMBODIMENTS

An embodiment of the present invention will now be described together with the drawings.

Figure 1:
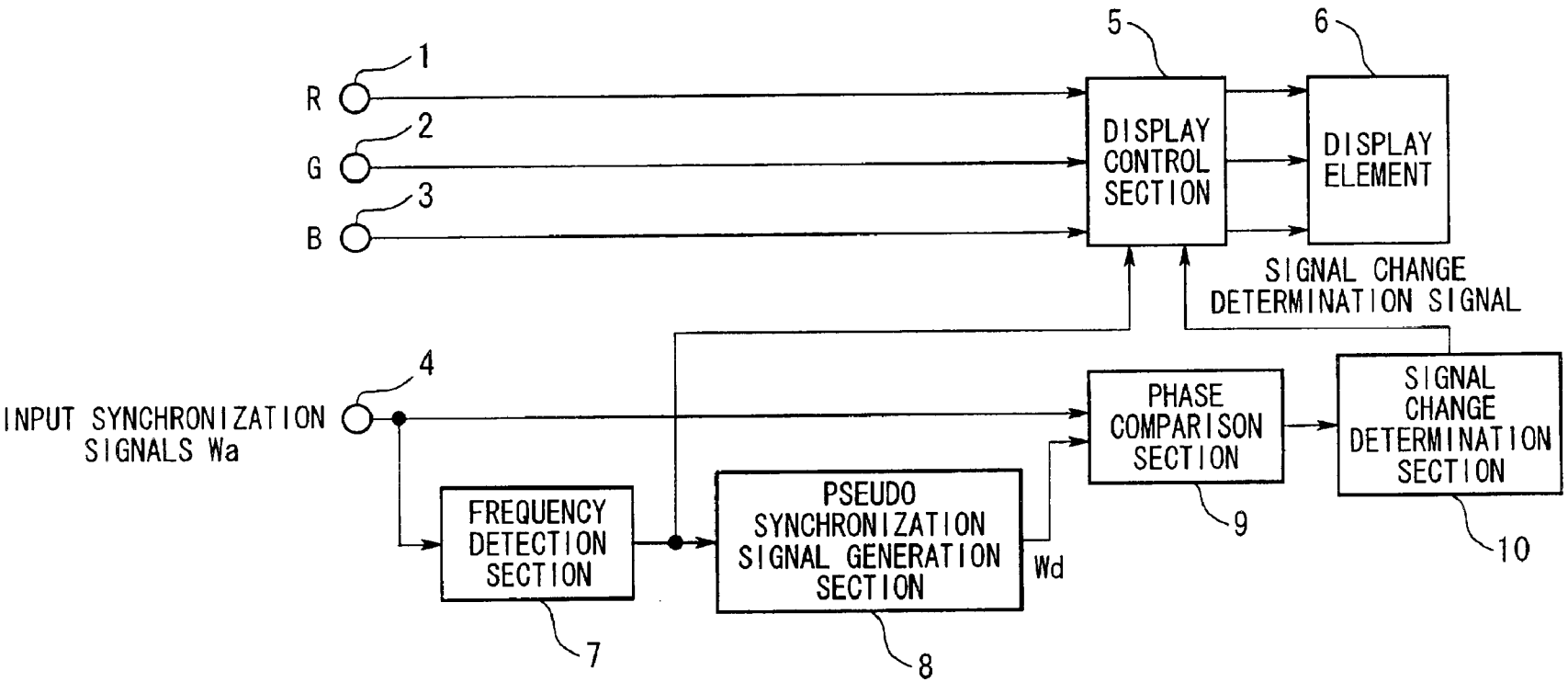
FIG. 1 is a block diagram showing a multi-sync display apparatus according to an embodiment of the present invention.

FIG. 1 is a block diagram showing a concept of the structure of the multi-sync display apparatus according to an embodiment of the present invention.

In FIG. 1, the symbol 1 indicates an input terminal into which a red (R) signal is input as an image signal from a PC (not shown), the symbol 2 indicates an input terminal into which the same type of green (G) signal is input, and the symbol 3 indicates an input terminal into which the same type of blue (B) signal is input. The symbol 4 indicates an input terminal into which are input horizontal and vertical signals synchronization signals Wa that are synchronized with the R, G, and B signals. Although not shown, there are provided a plurality of PCs, and each of the above signals is input into the respective input terminal by one of these PCs being selected by means of a switch.

The symbol 5 indicates a display control section that converts R, G, B signals into predetermined display signals based on identified input synchronization signals. The symbol 6 indicates a display element such as a liquid crystal that displays an image when the display signals are supplied thereto.

The symbol 7 indicates a frequency detection section that detects the frequency of input synchronization signals Wa. The symbol 8 indicates a pseudo synchronization signal creation section that creates pseudo synchronization signals Wd based on a detected frequency. The symbol 9 indicates a phase comparison section that performs a phase comparison on the pseudo synchronization signals Wd and the input synchronization signals Wa, and outputs comparison result signals when the two exceed a predetermined phase difference. The symbol 10 indicates a signal change determination section that outputs a signal change determination signal when the above comparison result signals are continuously output for a predetermined number of times N(N=2, 3, . . . ).

Next, the operation of the above structure will be described using the timing chart shown in FIG. 2.

R, G, B signals are input into the input terminals 1, 2, and 3 from PCs that are selected by means of a switch and are then supplied to the display control section 5. The synchronization signals Wa shown in FIG. 2 that have been synchronized with the R, G, B signals are input into the input terminal 4, and are supplied to the phase comparison section 9 and the frequency detection section 7.

Figure 2:
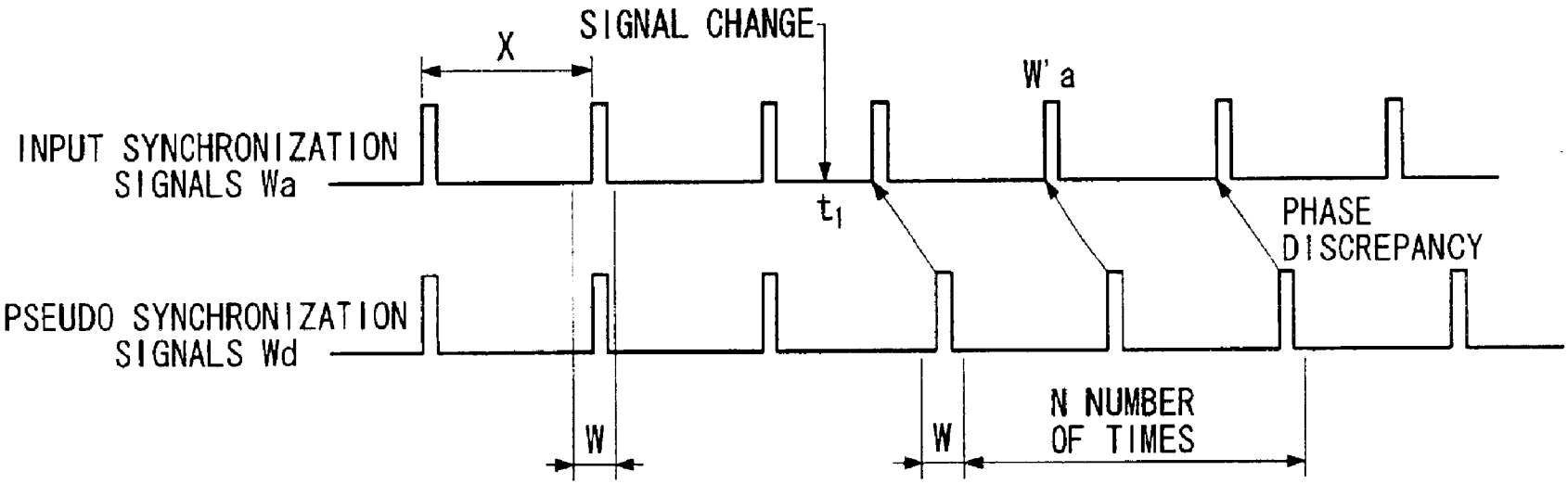
FIG. 2 is a timing chart showing the operation of FIG. 1.

The frequency (cycle) of the input synchronization signals Wa is detected by the frequency detection section 7, and based on the result of this detection the pseudo synchronization signal creation section 8 creates the pseudo synchronization signals Wd shown in FIG. 2. When the input synchronization signals Wa are within a comparison window having a predetermined width W, the pseudo synchronization signal creation section 8 creates pseudo synchronization signals Wd that are synchronized with these input synchronization signals Wa. When the input synchronization signals Wa are outside the comparison window, the pseudo synchronization signal creation section 8 creates pseudo synchronization signals Wd that have the frequency of the synchronization signal immediately prior to the input synchronization signals Wa outside the comparison window.

The pseudo synchronization signals Wd that have been created undergo phase comparison with the input synchronization signals Wa in the phase comparison section 9, and comparison result signals are output when the phase difference between the two exceeds a predetermined size. When the comparison result signals continue for a predetermined number of times N, the signal change determination section 10 determines that the signals have been changed (i.e., a synchronization signal change) by the switching of a switch, and outputs a signal change detection signal. Based on this signal change detection signal, the display control section 5 alters the display control settings in accordance with the frequency of the input synchronization signals Wa detected by the frequency detection section 7. Next, based on the above settings, the display control section 5 performs display control of the R, G, B signals switched by the switch, and creates display signals that are supplied to the display element 6. As a result, it is possible to display a normal image that that corresponds to the input synchronization signals Wa.

At this time, in FIG. 2, the frequency detection section 7 detects the frequency (the cycle X) of the input synchronization signals Wa. If the value of X is within the window having the width W, the pseudo synchronization signal creation section 8 generates pseudo synchronization signals Wd that are synchronized with the cycle X. Namely, if the input synchronization signals Wa are similar within the window X, then pseudo synchronization signals Wd are generated that correspond to that cycle. In this state, it is taken that the switch has been switched at the time t1 and that there has been a signal change. In this case, normally, the phases of the synchronization signals after the switching and of the synchronization signals before the switching do not match. If the amount of this phase mismatch exceeds W, as is shown in FIG. 2, the pseudo synchronization signal creation section 8 generates pseudo synchronization signals Wd having the same cycle as the cycle X of the synchronization signal immediately prior to the time t1.

Next, the phase comparison section 9 performs a phase comparison of the input synchronization signals Wa and the pseudo synchronization signals Wd, and outputs comparison result signals if the phase difference between the two exceeds W. These comparison result signals are output each time a synchronization signal Wa' that is formed after the signal change is input. The signal change determination section 10 outputs a signal change determination signal indicating that there has been a signal change when the comparison result signals are obtained continuously for a predetermined number of times N.

Namely, even if a phase difference that exceeds W is generated after the time t1, because it is not possible at that time to ascertain whether the phase difference is due to synchronization lapses or noise or due to an actual signal change, it is determined that the phase difference is due to a signal change only when the phase difference continues for a predetermined number of times N.

Accordingly, the width W of the window represents the phase difference detection sensitivity, namely, the sensitivity of the identification of the input synchronization signals. N also indicates the erroneous detection sensitivity. Namely, if W is set at a narrow width, then it is possible to raise the identification sensitivity. Furthermore, if N is set at a large value, then even if W is set at a narrow width the possibility of the occurrence of erroneous operation caused by synchronization lapses or noise or the like is reduced. Moreover, if N is set at a small value, the detection can be made in a shorter time.

Figure 3:
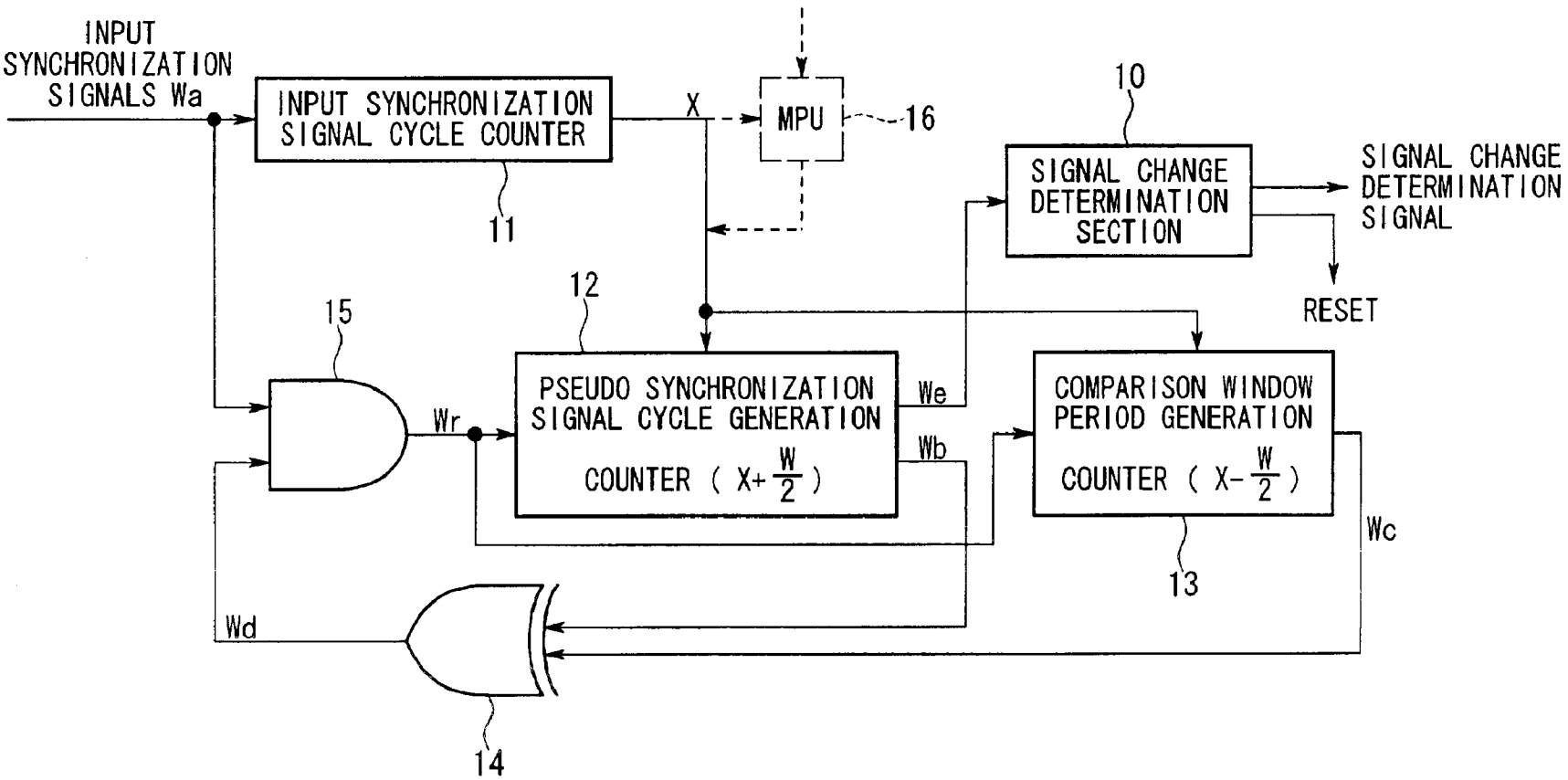
FIG. 3 is a block diagram showing examples of the structure of the frequency detection section 7, the pseudo synchronization signal creation section 8, and the phase comparison section 9 shown in FIG. 1.

FIG. 3 shows a structural example that contains the phase comparison section 9, the pseudo synchronization signal creation section 8, and the frequency detection section 7 functioning as a pseudo synchronization signal generation means.

In FIG. 3, the symbol 11 indicates an input synchronization signal cycle counter that counts the cycles X of the input synchronization signals Wa. The symbol 12 indicates a pseudo synchronization signal cycle generation counter that counts X+W/2 based on a result of a count by the counter 11. The symbol 13 indicates a comparison window period generation counter that counts X−W/2 based on a result of a count by the counter 11.

The symbol 14 indicates an EXOR circuit (i.e., an exclusive OR circuit) that receives the input of a count output Wb from the counter 12 and a count output Wc from the counter 13, and that outputs pseudo synchronization signals Wd. The symbol 15 indicates an AND circuit that receives the input of the pseudo synchronization signals Wd and the input synchronization signals Wa, and outputs reset signals Wr for the counters 12 and 13. The symbol 10 indicates the signal change determination section shown in FIG. 1 and outputs a signal change determination signal when a saturation signal We from the counter 12 continues for a predetermined number of times N. Note that the microprocessor (MPU) 16 indicated by the broken line is described below.

Next, the operation of the above structure will be described while referring to the timing chart shown in FIG. 4.

Figure 4:
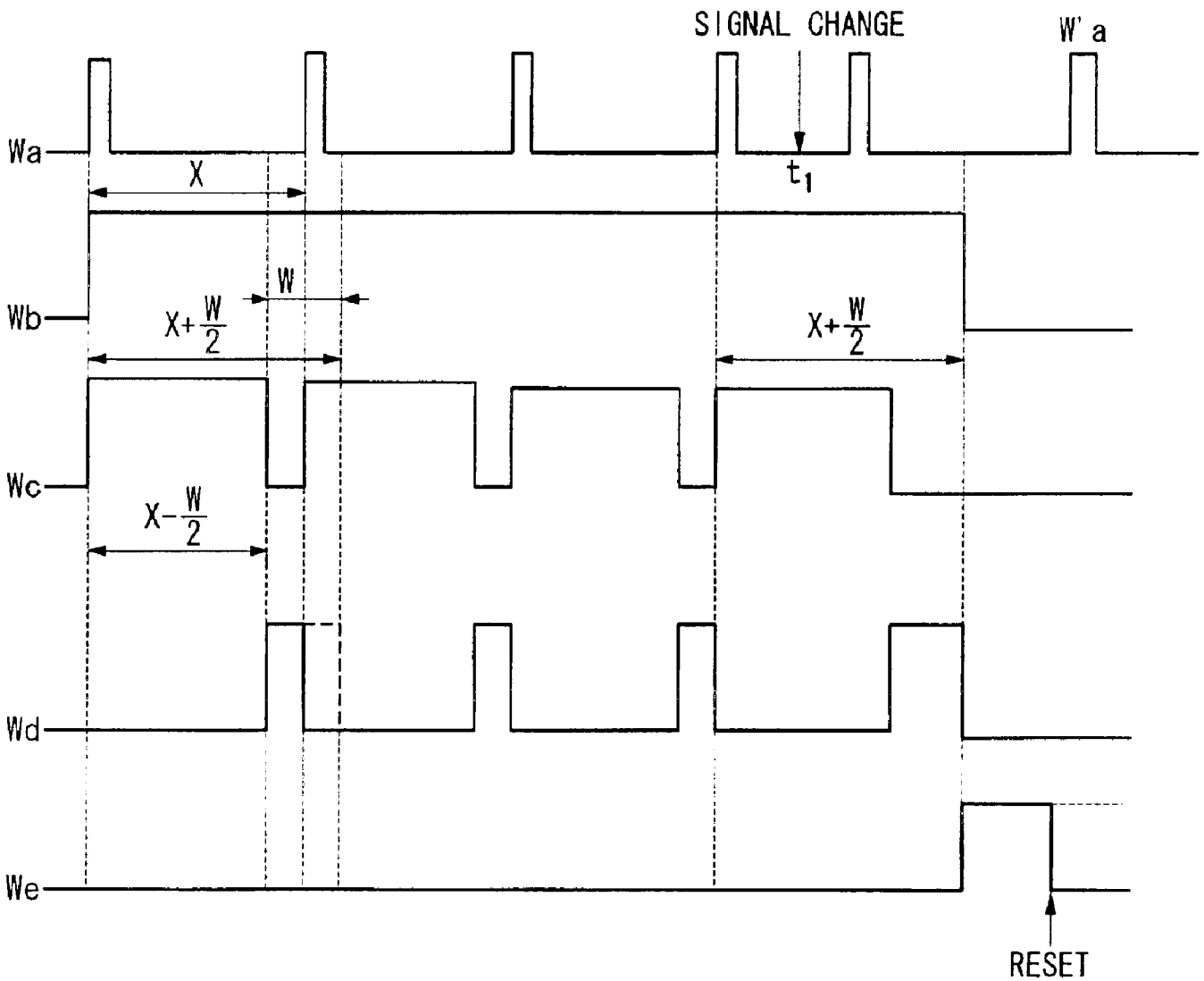
FIG. 4 is a timing chart showing the operation of FIG. 3.

In FIGS. 3 and 4, when the cycle X of the input synchronization signal Wa is counted by the counter 11, the counters 12 and 13 begin to count based on this, and the outputs Wb and Wc of the respective counters rise to H. Thereafter, if the rise of the input synchronization signals Wa is within a window having the width W, then because the counter 12 continues counting for X+W/2 or less, the output Wb continues for the period H. When the counter 13 counts X−W/2, the output We falls. By feeding this output Wb and the output Wc to the EXOR circuit 14, pseudo synchronization signals Wd are obtained within the above window by the EXOR circuit 14.

By feeding these pseudo synchronization signals Wd and the input synchronization signals Wa to the AND circuit 15, reset signals Wr are obtained by the AND circuit 15. The counters 12 and 13 are then forcibly reset by the reset signals Wr. In this case, the period from the end of the X−W/2 count by the counter 13 to the end of the X+W/2 count by the counter 12 is the reset receiving period. Namely, if the rise of the input synchronization signals Wa is within the window having the width W, then a reset is performed by the input synchronization signals Wa, and pseudo synchronization signals Wd that are synchronized with the input synchronization signals Wa are output.

Next, a signal change is generated at the time t1 and the cycle of the input synchronization signals Wa is shortened and goes outside the window. Therefore, even if the counter 12 ends the count X+W/2, because the next synchronization signal Wa' has not arrived the reset is not performed, the count is stopped, and the output Wb falls to L. At the same time as this, H saturation signals We are output and are fed to the signal change determination section 10. When the signal change determination section 10 receives the saturation signals We, the counter 12 is reset and the saturation signals We fall to L. When the signal change determination section 10 has received the saturation signals We continuously for N number of times, it determines that there has been a signal change and outputs a signal change determination signal.

Next, the MPU 16 shown by the dotted lines in FIG. 3 will be described.

This MPU 16 acquires each count value X counted a plurality of times by the counter 11, and determines a stable value thereof using a method such as taking the average value thereof. This value is then set in the counter 12. As a result, any unevenness in X or the like is absorbed, and it is possible to stabilize the operation. It is also possible to set the counter 12 using a value instructed from the outside.

What is claimed is:

1. A multi-sync display apparatus comprising:

a pseudo synchronization signal generation means that, when input synchronization signals are within a predetermined phase difference, generates pseudo synchronization signals that are synchronized with the input synchronization signals, and that, when the input synchronization signals exceed a predetermined phase difference, generates pseudo synchronization signals having a frequency of a synchronization signal directly before the input synchronization signal that exceeds the predetermined phase difference;

phase comparison means that performs phase comparison on the pseudo synchronization signals and the input synchronization signals, and outputs comparison result signals when the phase difference between the pseudo synchronization signals and the input synchronization signals exceeds a predetermined phase difference; and signal change determination means that, when the comparison result signals are continuously output for a plurality of times, outputs a signal change determination signal indicating that the input synchronization signals have changed.

2. The multi-sync display apparatus according to claim 1, wherein the pseudo synchronization signal generation means and the phase comparison means are formed by a first counter that counts a cycle X of the input synchronization signals, a second counter that counts X+W/2(wherein W is a value corresponding to a predetermined phase difference) based on a result of a count by the first counter, a third counter that counts X−W/2 based on a result of a count by the first counter, a pseudo synchronization signal generation circuit that generates pseudo synchronization signals between an end time of a count by the third counter and an end time of a count by the second counter, and a reset circuit that outputs second and third counter reset signals when pseudo synchronization signals and input synchronization signals are input, and wherein saturation signals from the second counter are input into the signal change means as the comparison result signals.

3. The multi-sync display apparatus according to claim 2, wherein there is provided setting means that determines a stable value from several count values of the first counter, and sets the stable value in the second counter.

4. The multi-sync display apparatus according to claim 1, wherein there is provided display control means that controls display of image signals input in synchronization with the input synchronization signals based on the signal change determination signal and the frequency of the input synchronization signals, and a display element that displays the image signals whose display is being controlled by the display control means.

5. The multi-sync display apparatus according to claim 2, wherein there is provided display control means that displays image signals input in synchronization with the input synchronization signals based on the signal change determination signal and the frequency of the input synchronization signal, and a display element that displays the image signals whose display is being controlled by the display control means.

6. The multi-sync display apparatus according to claim 3, wherein there is provided display control means that displays image signals input in synchronization with the input synchronization signals based on the signal change determination signal and the frequency of the input synchronization signals, and a display element that displays the image signals whose display is being controlled by the display control means.

* * * * *